US009498100B2

(12) United States Patent
Conway et al.

(10) Patent No.: US 9,498,100 B2
(45) Date of Patent: Nov. 22, 2016

(54) APPARATUS TO RETAIN A CLEANING IMPLEMENT

(71) Applicant: S.C. Johnson & Son, Inc., Racine, WI (US)

(72) Inventors: Simon M. Conway, Burlington, WI (US); Linda J. Babinski, Kenosha, WI (US); Kate Schreiber, Milwaukee, WI (US); Robert T. Wosewick, Shorewood, WI (US); Stephen M. Oshgan, Des Plaines, IL (US); Jason R. Gebhardt, Buffalo Grove, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 210 days.

(21) Appl. No.: 14/541,301

(22) Filed: Nov. 14, 2014

(65) Prior Publication Data

US 2015/0139721 A1 May 21, 2015

Related U.S. Application Data

(60) Provisional application No. 61/905,080, filed on Nov. 15, 2013.

(51) Int. Cl.

| | |
|---|---|
| ***A47L 13/46*** | (2006.01) |
| ***A47L 13/255*** | (2006.01) |
| ***A47L 13/24*** | (2006.01) |
| ***A47L 13/42*** | (2006.01) |
| ***B25G 3/24*** | (2006.01) |

(52) U.S. Cl.

CPC ..... *A47L 13/255* (2013.01); *A47L 13/24* (2013.01); *A47L 13/42* (2013.01); *A47L 13/46* (2013.01); *B25G 3/24* (2013.01); *Y10T 403/595* (2015.01)

(58) Field of Classification Search

CPC ..... A46B 3/14; A46B 3/18; A46B 3/24; A46B 3/112; B25B 7/14; B25B 5/06; A47L 13/146; A47L 13/20; A47L 13/24; A47L 13/42; A47L 13/46

See application file for complete search history.

(56) References Cited

U.S. PATENT DOCUMENTS

| | | | | |
|---|---|---|---|---|
| 627,746 | A | 6/1899 | Dobbins | |
| 1,033,972 | A | 7/1912 | Wesburg | |
| 2,328,287 | A * | 8/1943 | Martin | A47L 13/46 15/150 |
| 2,672,639 | A * | 3/1954 | Bruger | A47L 1/06 15/146 |
| 2,683,886 | A * | 7/1954 | Neumann | A47L 13/12 15/114 |
| 3,605,161 | A | 9/1971 | Moss et al. | |
| 3,813,724 | A | 6/1974 | Unger | |
| 4,015,305 | A | 4/1977 | Komatsu | |
| 5,041,028 | A * | 8/1991 | Stohle | B25B 5/06 439/822 |
| 5,842,371 | A * | 12/1998 | Liaw | H01R 43/042 29/751 |
| 5,852,852 | A | 12/1998 | Rigal | |
| 6,094,771 | A | 8/2000 | Egolf et al. | |

(Continued)

OTHER PUBLICATIONS

International Search Report and Written Opinion for PCT/US2014/065644 dated Feb. 6, 2014.

*Primary Examiner* — Daniel Wiley

(57) ABSTRACT

An apparatus to retain an article includes a housing, a first jaw, a second opposed jaw, a pivoting ratchet arm, and a lever. The housing is adapted to receive a handle. The first jaw is adapted to pivot with respect to the housing. The pivoting ratchet arm is dimensioned to engage ratchet teeth of the first jaw when in an actuated position. The lever is connected to the ratchet arm and actuating the lever causes the ratchet arm to move into the actuated position to incrementally pivot the first jaw toward the second jaw.

17 Claims, 13 Drawing Sheets

(56) References Cited

U.S. PATENT DOCUMENTS 6,116,124 A * 9/2000 Ping ..... B25B 7/10 81/319
6,161,242 A 12/2000 Cabrero Gomez et al.
6,240,815 B1 * 6/2001 Huang ..... B25B 5/06 269/6
6,336,386 B1 * 1/2002 Lee ..... B25B 7/18 269/6
6,564,703 B1 * 5/2003 Lin ..... B25B 5/06 100/234
6,654,980 B2 12/2003 Biggs
6,684,465 B1 * 2/2004 Jo ..... B25B 5/06 24/344
6,745,441 B1 * 6/2004 Lin ..... B25B 5/06 100/234
6,973,859 B2 * 12/2005 Noniewicz ..... B25B 7/02 269/3
7,059,008 B2 6/2006 Morgan et al.
7,159,265 B2 1/2007 Soller et al.
7,178,189 B1 2/2007 Perry et al.
7,306,212 B2 * 12/2007 Cantin ..... B25B 5/06 269/3
7,827,648 B2 11/2010 Soller et al.
7,900,539 B2 * 3/2011 Meissner ..... B25B 25/00 254/237
2002/0000707 A1 1/2002 Couderc
2006/0208407 A1 * 9/2006 Wang ..... B25B 5/06 269/6
2010/0162539 A1 7/2010 Rancon
2010/0314816 A1 * 12/2010 Yang ..... B25B 7/14 269/214
2014/0331825 A1 * 11/2014 Khristyuchenko ..... B25B 7/18 81/393

* cited by examiner

APPARATUS TO RETAIN A CLEANING IMPLEMENT

CROSS-REFERENCES TO RELATED APPLICATIONS

This application claims priority from U.S. Patent Application No. 61/905,080 filed Nov. 15, 2013.

STATEMENT REGARDING FEDERALLY SPONSORED RESEARCH

Not Applicable.

BACKGROUND OF THE INVENTION

1. Field of the Invention

This invention relates to an apparatus to retain an article, such as a cleaning implement, and in particular to an apparatus adapted to securely retain and easily release a cleaning implement.

2. Description of the Related Art

One type of available cleaning tool for cleaning hard surfaces such as floors includes a handle connected to an apparatus that engages a disposable or reusable cleaning implement. To clean a floor, a cleaning implement can be secured to the apparatus. The cleaning implement is brought into contact with the floor and moved along the floor surface in horizontal directions. Debris from the floor surface is entrained within structure of the cleaning implement. After use, the cleaning implement may be removed from the apparatus for disposal or cleaning prior to reuse of the cleaning implement.

Cleaning implements may become wet and soiled during the cleaning process. Traditional devices to retain cleaning implements may require a user to physically handle the soiled cleaning implement to clean or dispose of the cleaning implement after use. Further, many devices for retaining cleaning implements are not easy to use.

What is needed therefore is an apparatus in which a user can easily attach and remove a cleaning implement after the cleaning implement is no longer needed.

SUMMARY OF THE INVENTION

The foregoing needs can be met with an apparatus for retaining an article, such as a cleaning implement, wherein the apparatus is adapted to quickly and easily receive the article. In one non-limiting example form, the apparatus includes a pair of jaws adapted to be closed by a ratcheting mechanism. In another non-limiting example form, the support is a handle of a hand held cleaning implement.

In one embodiment, an apparatus to retain an article includes a housing, a first jaw, a second opposed jaw, a pivoting ratchet arm, and a lever. The housing is adapted to receive a handle. The first jaw is adapted to pivot with respect to the housing. The pivoting ratchet arm is dimensioned to engage ratchet teeth of the first jaw when in an actuated position. The lever is connected to the ratchet arm and actuating the lever causes the ratchet arm to move into the actuated position to incrementally pivot the first jaw toward the second jaw.

In another embodiment, the apparatus further includes a lock dimensioned to engage the ratchet teeth of the first jaw. The lock retains the first jaw in position after the lever is returned to a pre-actuated position.

In still another embodiment, the apparatus further includes a release button dimensioned to engage the lock. Actuating the release button pivots the lock from the ratchet teeth of the first jaw and the first jaw is biased by a spring to pivot away from the second jaw.

In yet another embodiment, the lock includes more than one flange and the distal end of the flanges are configured to engage the ratchet teeth of the first jaw.

In another embodiment, a distal end of the ratchet arm is configured to pass between the flanges of the lock when the lever is actuated between the pre-actuated position and an actuated position.

In still another embodiment, the ratchet arm is biased by a spring to pivot away from the ratchet teeth of the first jaw when the lever is moved from the actuated position to the pre-actuated position.

In yet another embodiment, the lock is biased by a spring to pivot toward the ratchet teeth of the first jaw when the release button is released.

In another embodiment, the housing includes at least one aperture adapted to receive a retaining feature of the handle.

In still another embodiment, the housing includes a gripping portion.

In yet another embodiment, an apparatus to retain a cleaning implement includes a housing, a first jaw, a second opposed jaw, a pivoting ratchet arm, and a lever. The housing is adapted to receive a handle. The first jaw and the second opposed jaw form an opening configured to receive the cleaning implement. The first jaw is adapted to pivot with respect to the housing. The pivoting ratchet arm is dimensioned to engage a gear portion of the first jaw when in an actuated position. The lever is connected to the ratchet arm. Actuating the lever from a first pre-actuated position to a second actuated position causes the ratchet arm to engage the gear portion in an actuated position to incrementally pivot the first jaw toward the second jaw to reduce the opening.

In another embodiment, the apparatus further includes a u-shaped lock. Distal ends of the u-shaped lock are configured to engage the gear portion of the first jaw.

In still another embodiment, the apparatus further includes a release button. The release button includes a distal end configured to engage a base portion of the u-shaped lock. Actuating the release button pivots the distal ends of the u-shaped lock away from the gear portion of the first jaw. The first jaw is biased by a spring to pivot away from the second jaw.

In yet another embodiment, a distal end on the ratchet arm is configured to pass through an open end of the u-shaped lock when the lever is actuated between the first position and the second position to engage the gear portion of the first jaw.

In another embodiment, the ratchet arm is biased by a spring to pivot away from the gear portion of the first jaw when the lever is moved from the actuated position to the pre-actuated position.

In still another embodiment, the lock is biased by a spring to pivot toward the gear portion of the first jaw when the release button is released.

In yet another embodiment, the housing includes at least one aperture adapted to receive a retaining feature of the handle.

In another embodiment, the housing includes a gripping portion.

In still another embodiment, the distal end of the release button is biased by a spring away from the base portion of the lock.

In yet another embodiment, the gear portion projects from a rear portion of the first jaw.

In another embodiment, the first jaw and the second jaw include a plurality of teeth configured to grip the cleaning implement.

The invention provides versatility to easily attach and remove articles, such as cleaning implements, of different types. In one non-limiting example of an apparatus for retaining cleaning implements, a locking ratchet mechanism enables a user to retain and release cleaning implements without touching the cleaning implement. In addition, the apparatus may be attached to different types of handles depending on a user's needs. Lastly, the ratchet mechanism of the apparatus provides a mechanical advantage to the user so a cleaning implement can be securely retained without a significant physical effort.

Previous products do not address the user need of easily retaining a new cleaning implement or removing a soiled cleaning implement without having to touch the cleaning implement.

These and other features, aspects, and advantages of the present invention will become better understood upon consideration of the following detailed description and drawings.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
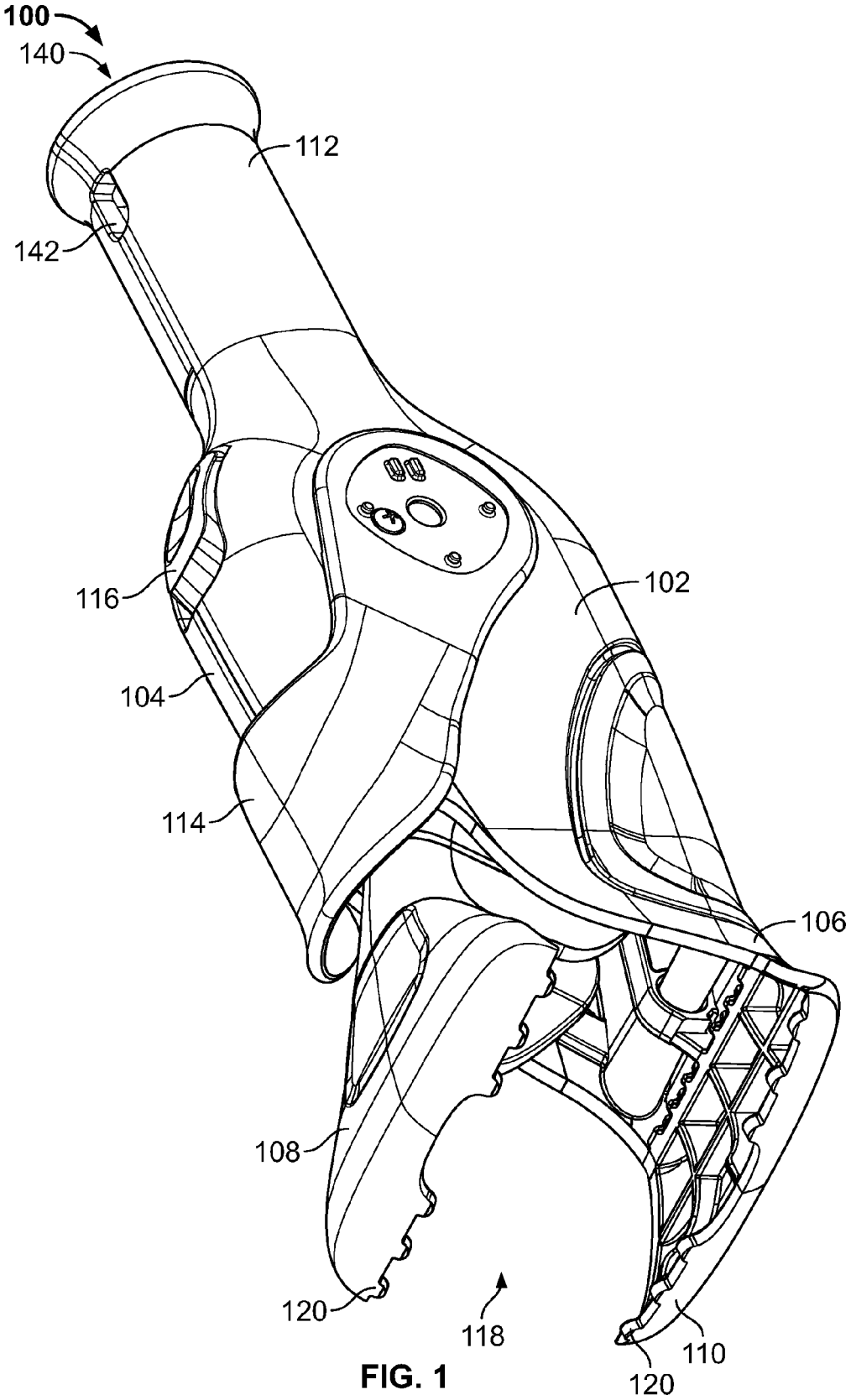
FIG. 1 is a perspective view of one embodiment of an apparatus for retaining an article, such as a cleaning implement.
Figure 2:
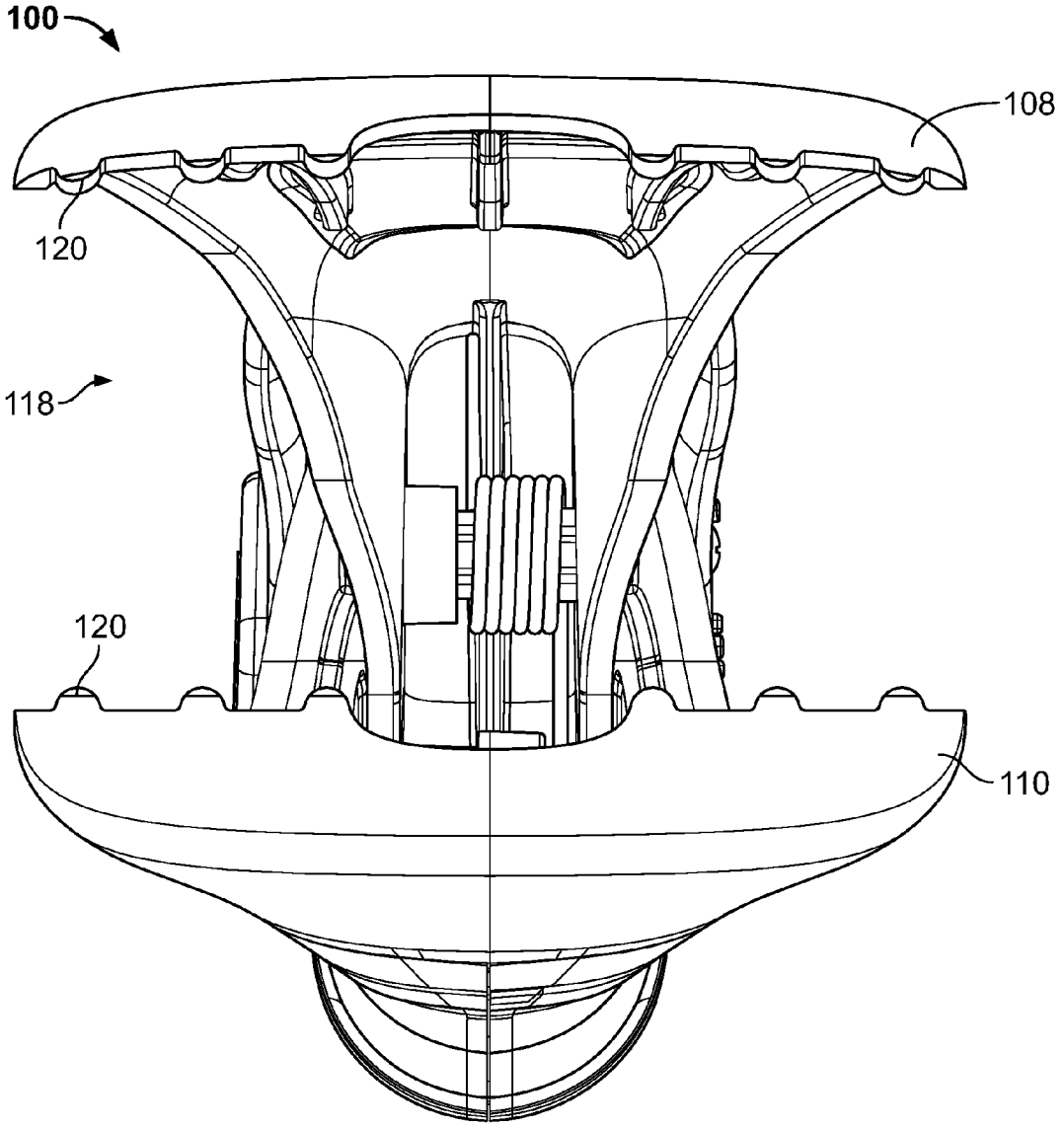
FIG. 2 is a front view of the apparatus of FIG. 1.
Figure 3:
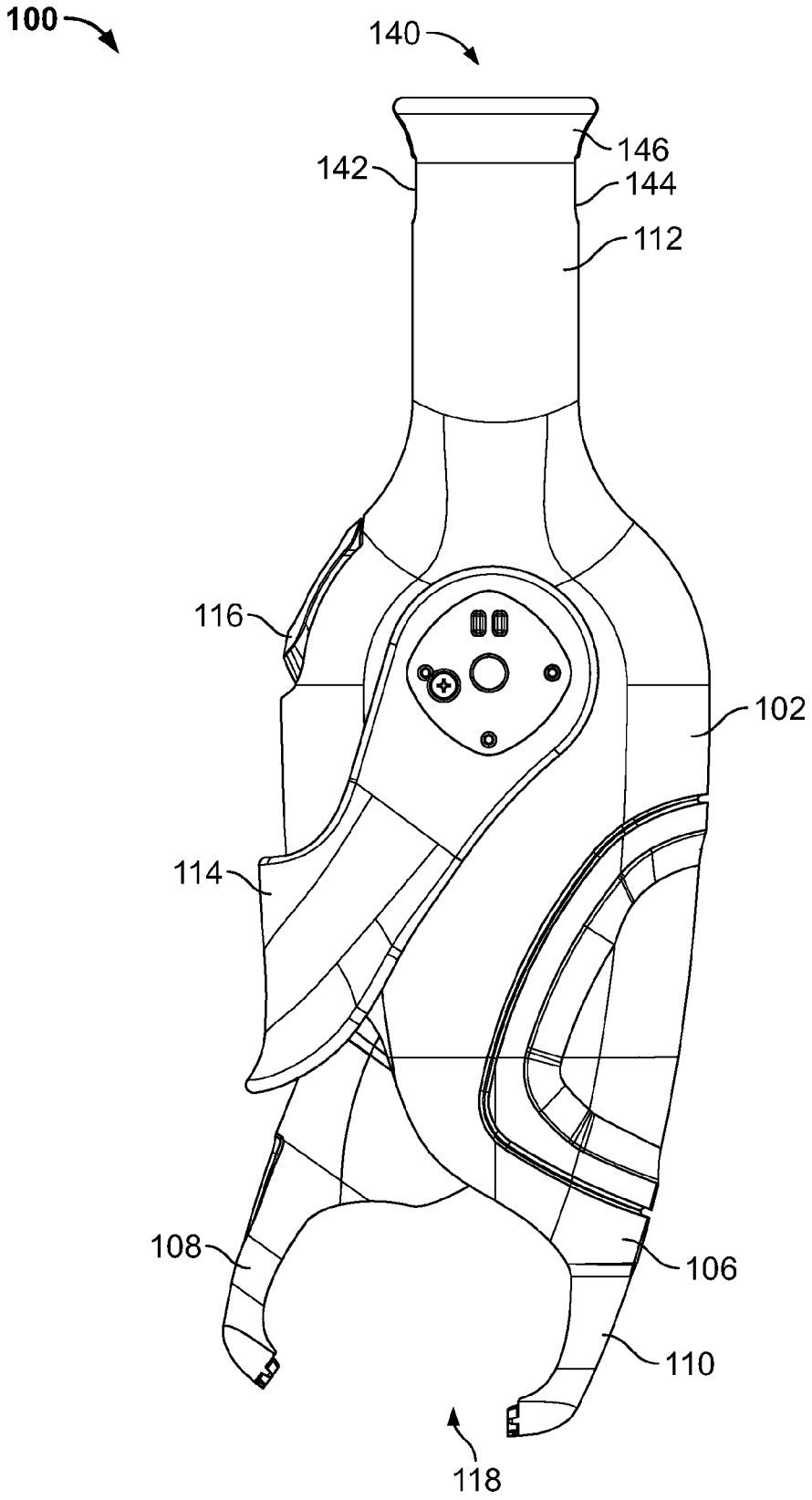
FIG. 3 is a left side view of the apparatus of FIG. 1.

Various embodiments of the invention will now be described with reference to the Figures. The embodiments are shown and described for the purposes of illustration and are not intended to limit the invention in any way. One non-limiting example embodiment of the invention described below provides an apparatus adapted to retain a cleaning implement. However, more generally, the invention provides a retaining apparatus, wherein the apparatus is adapted to receive an article. In an alternative non-limiting example embodiment, the apparatus can be attached to a handle and retain a cleaning implement, such as a mop head.

Referring now to FIGS. 1-7, an apparatus 100 for retaining a cleaning implement 220 (see FIG. 13) is depicted. The apparatus includes a housing 102 and a cover 104. Extending from a first end 106 of the apparatus 100 are a first jaw 108 and an opposed second jaw 110. A second end 112 of the apparatus 100 is configured to receive a handle 222. The apparatus further includes a lever 114 and a release button 116.

Figure 11:
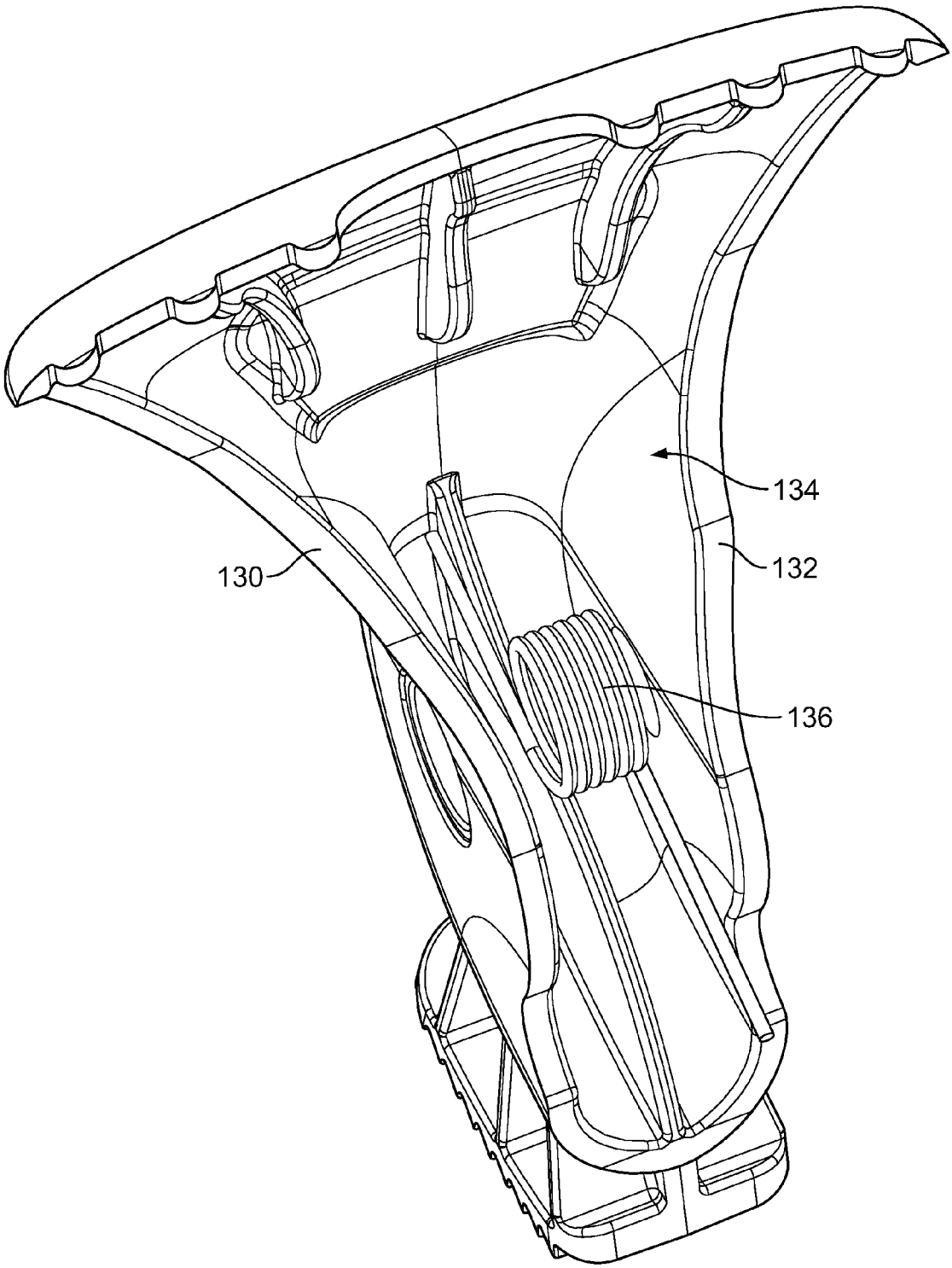
FIG. 11 is a bottom perspective view of an upper retaining jaw of the apparatus of FIG. 1.

The first jaw 108 and the second jaw 110 form an opening 118 adapted to receive a cleaning implement 220. The first jaw 108 is designed to pivot toward the opposed second jaw 110. In the present embodiment, the second jaw 110 is rigidly held by the housing 102 and the cover 104. Both the first jaw 108 and the second jaw 110 include teeth 120 for aiding in gripping a cleaning implement 220. The first jaw 108 includes two sidewalls 130, 132 that form an interior cavity 134 (see FIG. 11). Contained within the cavity 134 is a first jaw spring 136. In the present embodiment, the spring 136 is a torsion type spring. When the apparatus 100 is in a non-actuated state, the spring 134 provides a force to prevent the first jaw 108 from pivoting toward the second jaw 110.

Figure 4:
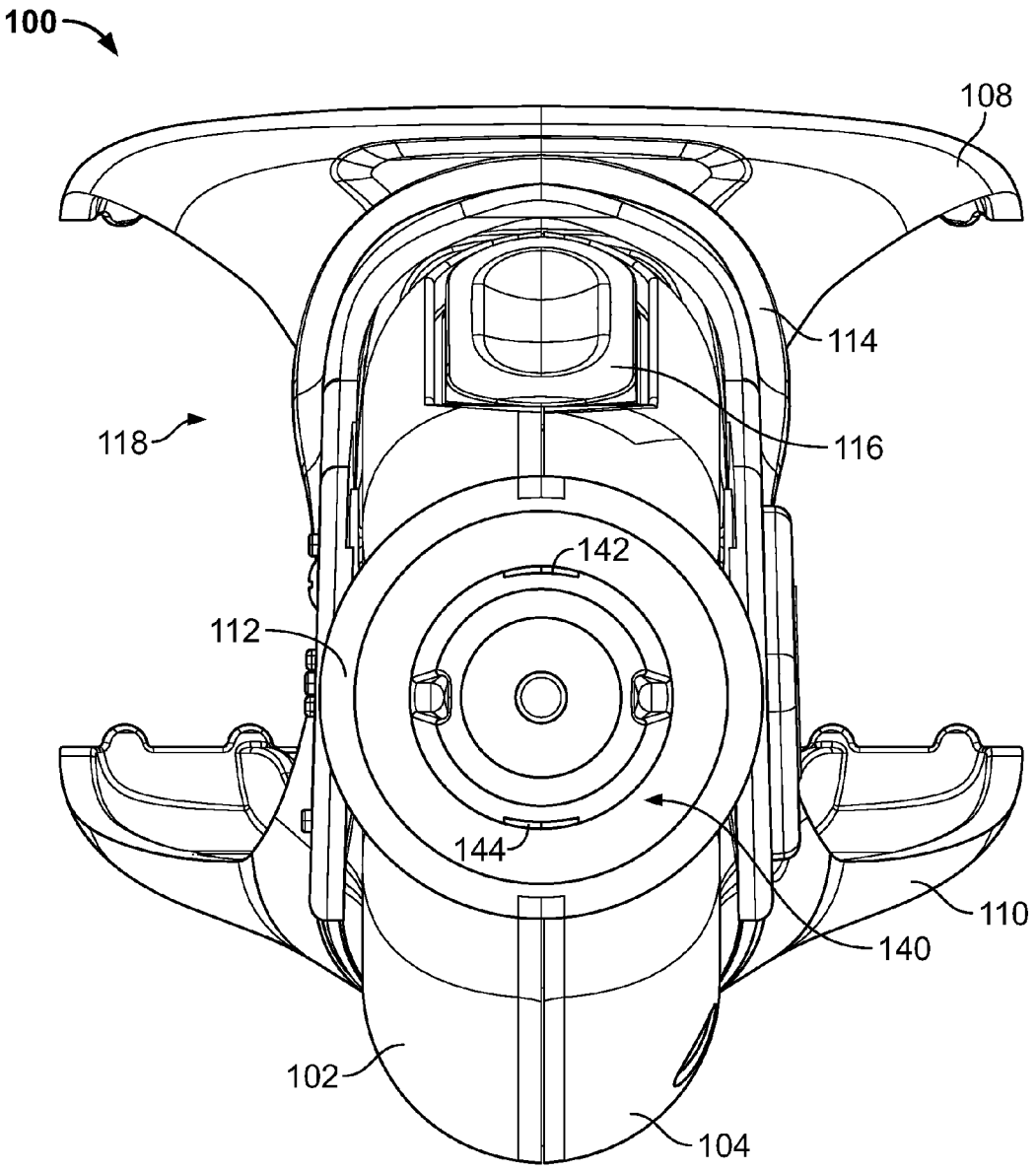
FIG. 4 is a rear view of the apparatus of FIG. 1.
Figure 5:
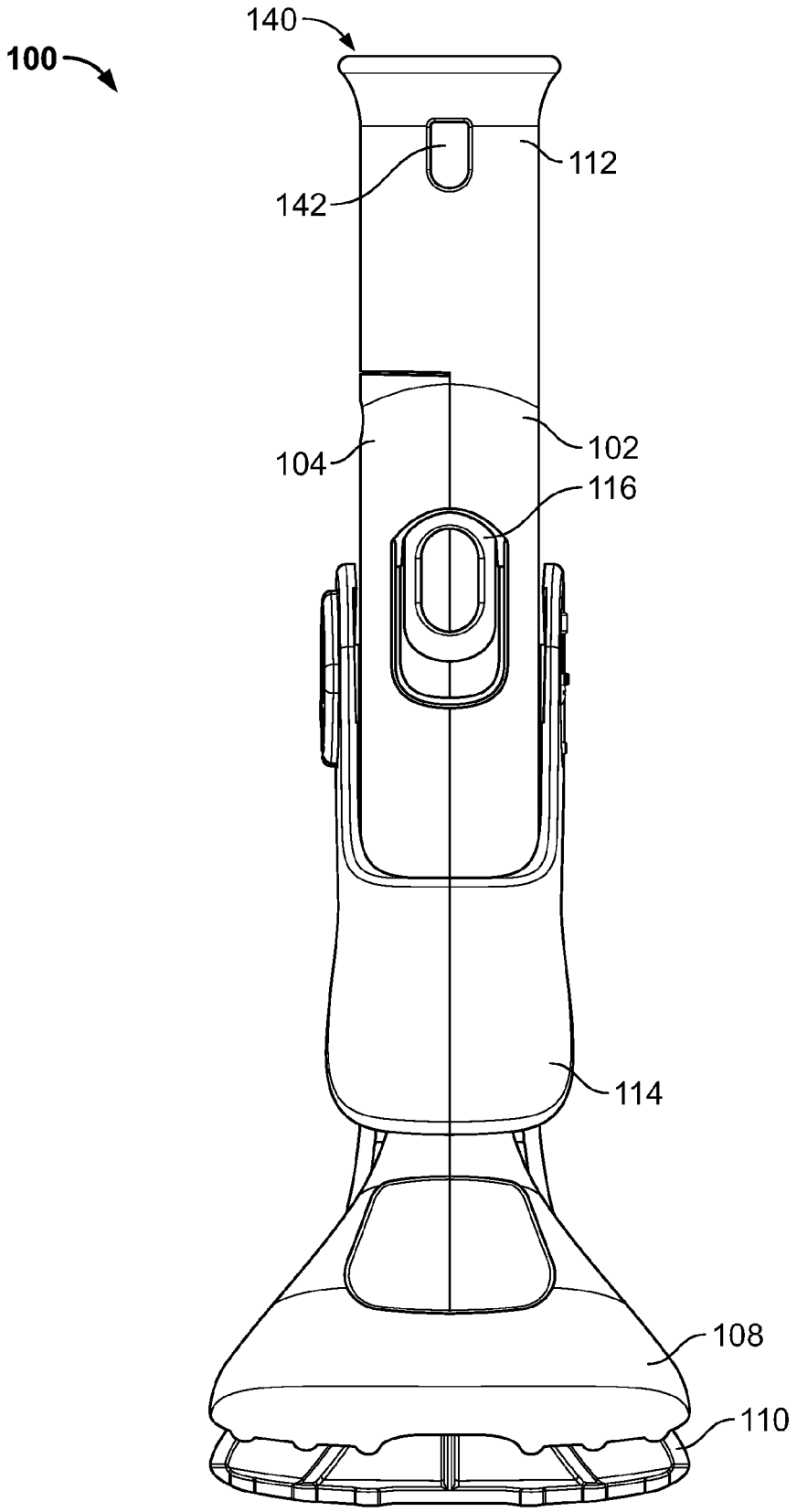
FIG. 5 is a top view of the apparatus of FIG. 1.
Figure 6:
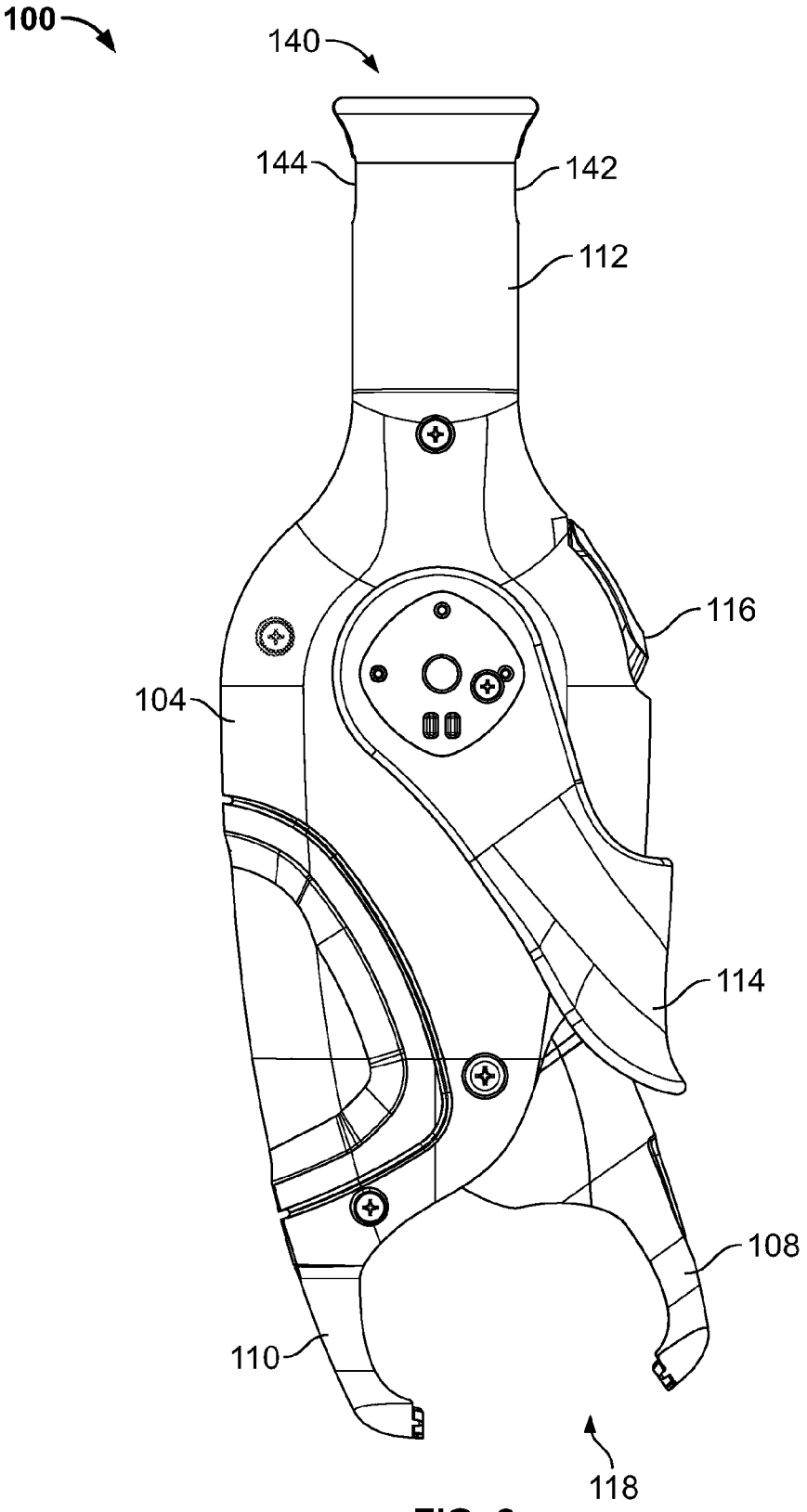
FIG. 6 is a right side view of the apparatus of FIG. 1.
Figure 7:
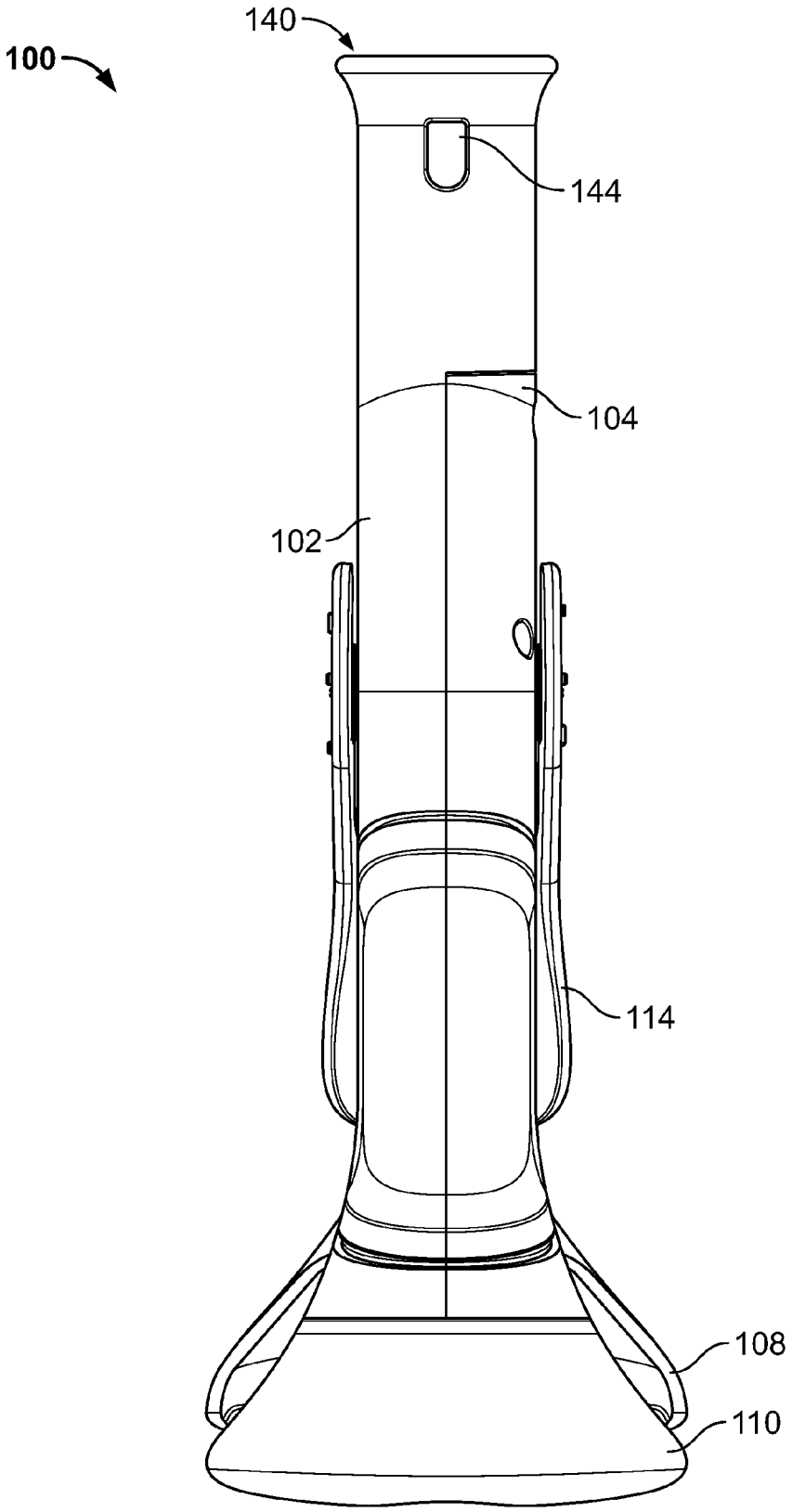
FIG. 7 is a bottom view of the apparatus of FIG. 1.

In the present embodiment shown in FIG. 4, the second end 112 of the apparatus 100 includes a receptacle 140 that is adapted to receive a handle (not shown). The receptacle includes two opposed apertures 142, 144 that are adapted to receive a spring clip 224 of a handle 222 (see FIG. 13). The second end 112 of the apparatus 100 further includes a tapered section 146. When a user inserts a handle 222 into the receptacle 140, the tapered section 146 serves several purposes. First, the tapered section helps guide the end of the handle 222 into the receptacle 140. Second, the tapered section helps prevent the user from being pinched between the second end 112 of the apparatus 100 and the handle 222.

Figure 9:
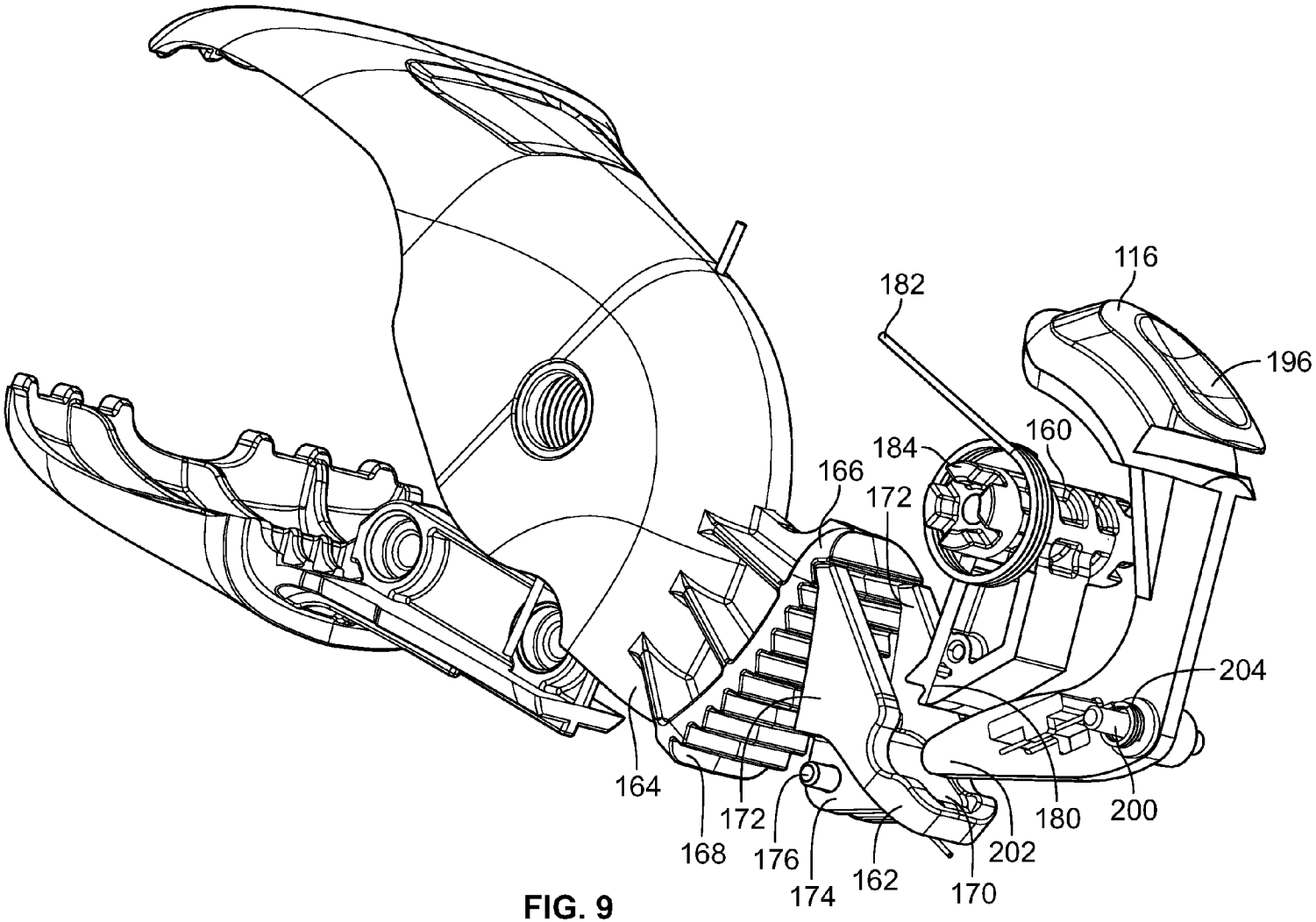
FIG. 9 is a rear perspective of a ratcheting mechanism, retaining jaws, and release button of the apparatus of FIG. 1 with the outer housing removed.
Figure 10:
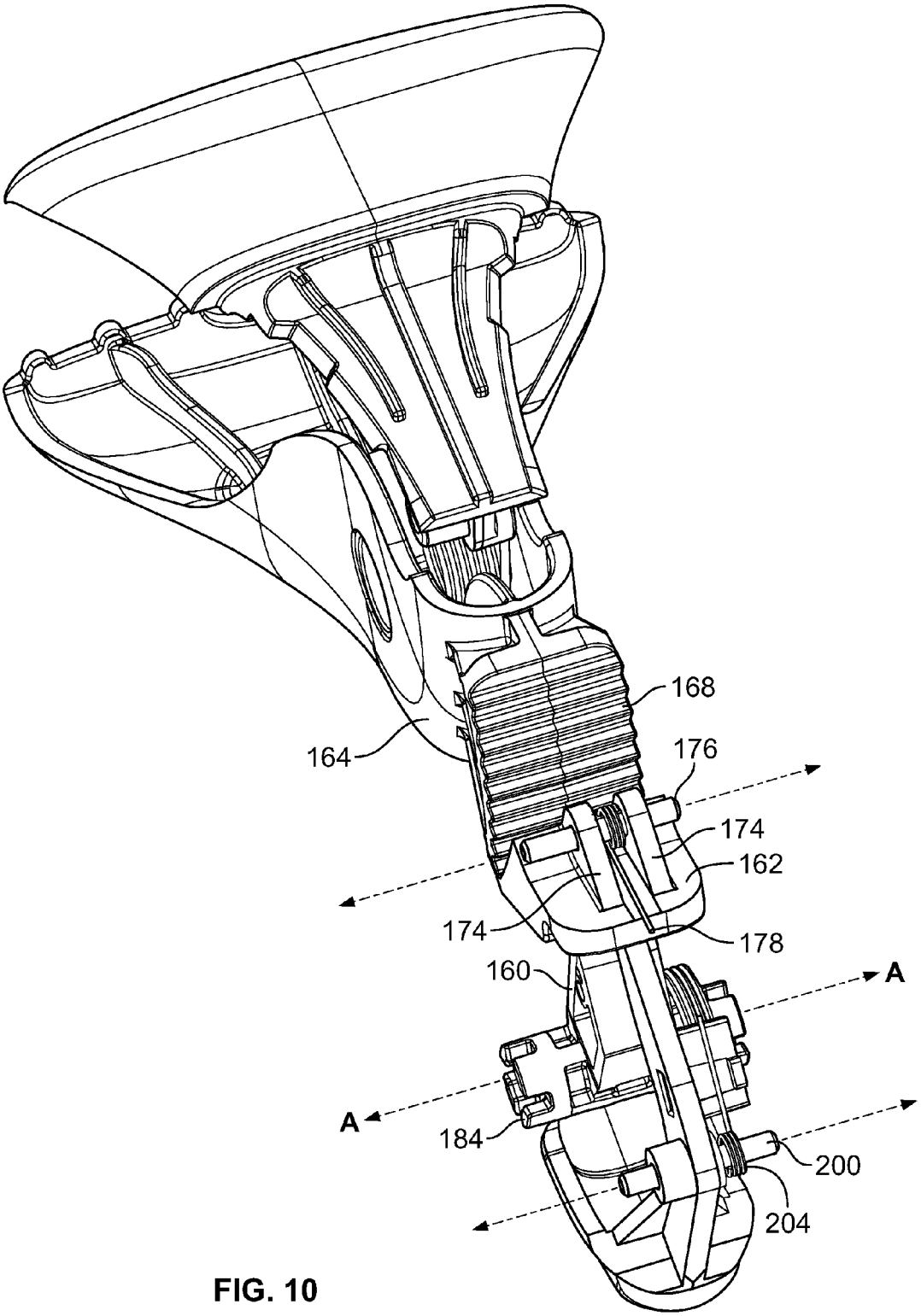
FIG. 10 is a bottom perspective of a ratcheting mechanism, retaining jaws, and release button of the apparatus of FIG. 1 with the outer housing removed.

Now referring to FIGS. 9 and 10, the apparatus 100 is depicted with the lever 114, the housing 102, and the cover 104 removed. The apparatus 100 includes a ratchet arm 160 and a lock 162. Extending from a rear portion 164 of the first jaw 108 is a gear portion 166. The gear portion 166 of the first jaw 108 includes a plurality of ratchet teeth 168. In the present embodiment, the lock 162 is generally U shaped and has a base portion 170 and two arm portions 172. The base portion 170 includes two flanges 174 for connecting the lock 162 to a lock pivot 176. A lock spring 178 is position between the two flanges 178 and around the lock pivot 176 to bias the lock 162 into a position so that the arm portions 172 of the lock 162 engage at least one of the plurality of ratchet teeth 168.

Still referring to FIGS. 9 and 10, the ratchet arm 160 is adapted to rotate around an axis A (see FIG. 10). A distal end 180 of the ratchet arm 160 is adapted to engage at least one of the plurality of ratchet teeth 168 of the first jaw 108. A ratchet spring 182 biases the ratchet arm 160 in a position so that the distal end 180 is not engaged with the plurality of ratchet teeth 168. A plurality of ratchet protrusions 184 extend from the ratchet arm 160 parallel to the axis of rotation A. The plurality of ratchet protrusions 184 are adapted to interlock with a plurality of lever protrusions 186 (see FIG. 8) of the lever 114. The interlocking of the ratchet protrusions 184 and the lever protrusions 186 allow the ratchet arm 160 to rotate about the A axis when the lever arm 114 is moved from a pre-actuated position 190 to an actuated position 192 (see FIGS. 12A and 12B).

The release button 116 includes a first portion 196 adapted to be pressed by a user and a second portion 198. The second portion 198 of the release button 116 is generally L-shaped and includes a release pivot 200. A distal end 202 of the release button 116 is adapted to engage the base portion 170 of the lock 162. The release button 116 rotates about the release pivot 200 when actuated by the user. A release button spring 204 biases the release button 116 so that the distal end 202 of the release button 116 is away from the base portion 170 of the lock 162 when the release button 116 is not actuated by a user.

Figure 8:
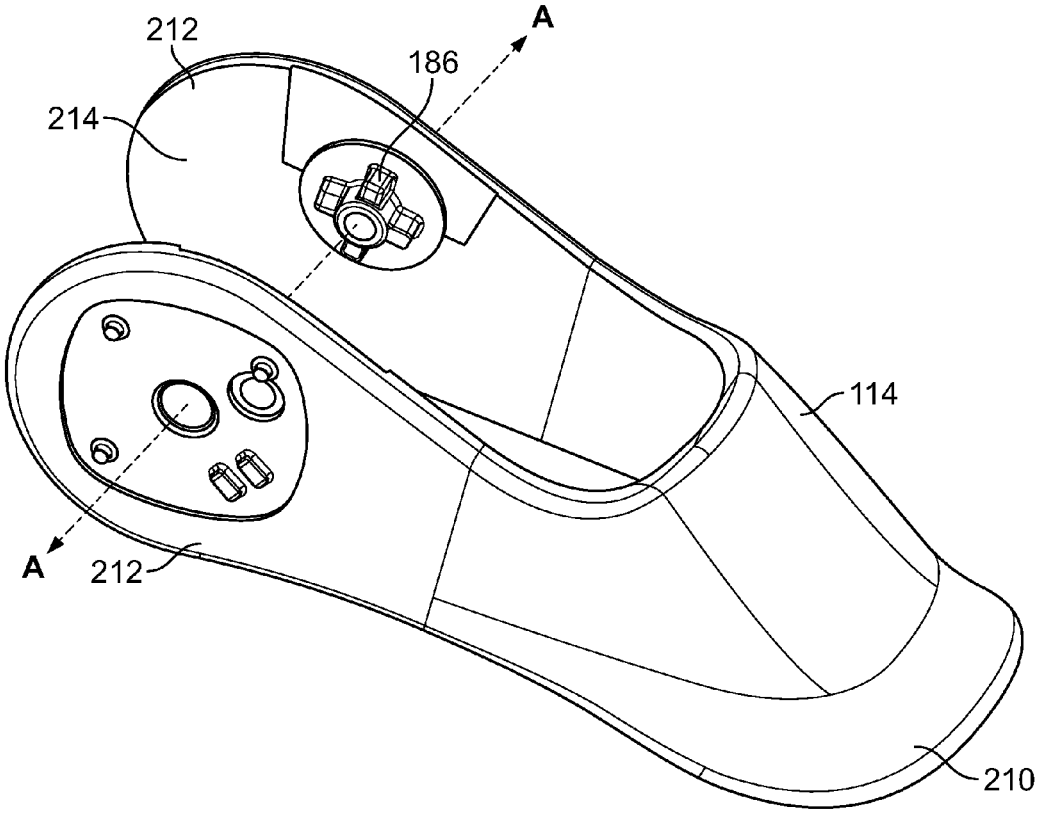
FIG. 8 is a top perspective view of a lever of the apparatus of FIG. 1.

Referring now to FIG. 8, the lever 114 is depicted. The lever 114 is generally u-shaped and includes a gripping portion 210 and two arm portions 212. The lever protrusions 186 extend from an inner surface 214 of the lever 114 and are generally parallel to the A axis.

Figure 12B:
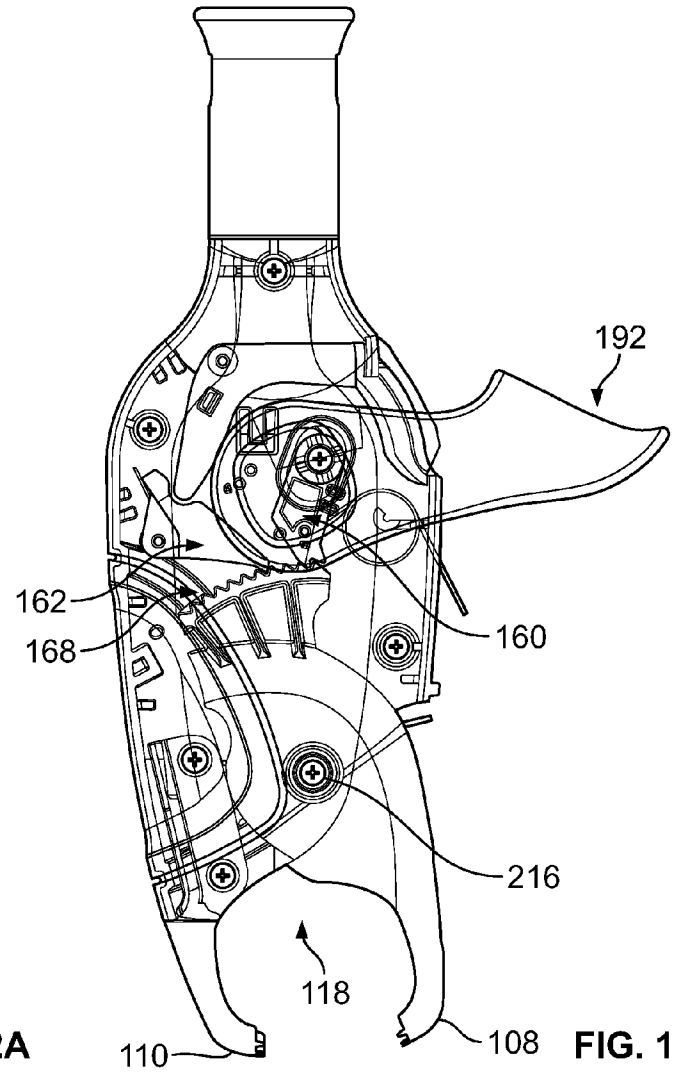
FIG. 12B is a right side view of the apparatus of FIG. 1 with the right side outer housing removed showing a ghost image of the actuating lever in a post-actuated position.
Figure 12A:
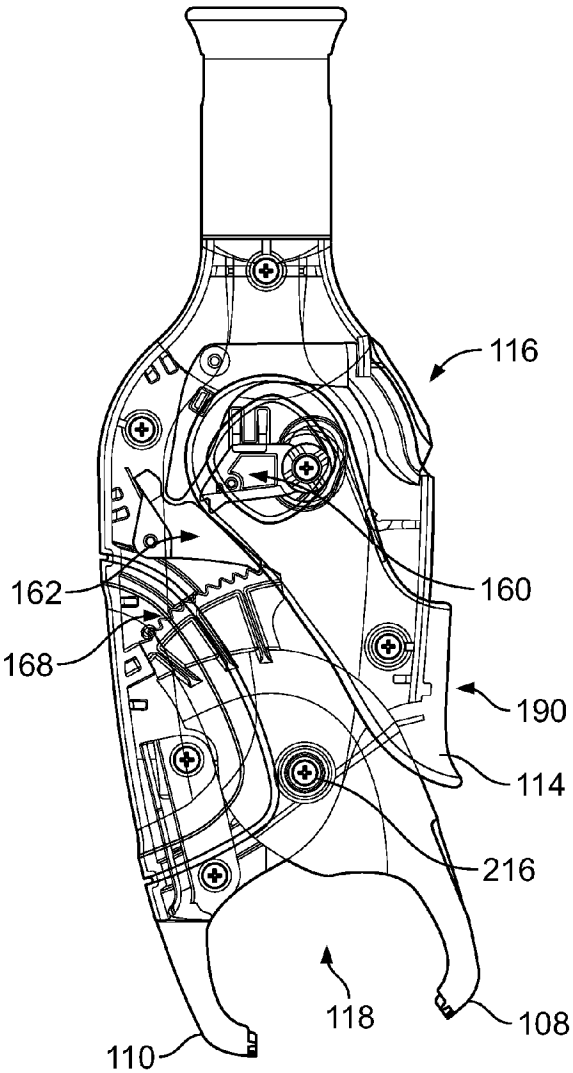
FIG. 12A is a right side view of the apparatus of FIG. 1 with the right side outer housing removed showing a ghost image of the actuating lever in a pre-actuated position.

Referring now to FIGS. 12A and 12B, the operation of the apparatus 100 will be described. FIG. 12A depicts the apparatus 100 having the lever 114 in a pre-actuated position 190. The arm portions 172 of the lock 162 are engaging at least one of the plurality of ratchet teeth 168 on the gear portion 166 of the first jaw 108. FIG. 12B depicts the apparatus 100 having the lever 114 in an actuated position 192.

To retain a cleaning implement 220 between the first jaw 108 and the second jaw 110, the user may place the portion of the cleaning implement 220 to be gripped by the apparatus 100 between the first jaw 108 and the second jaw 110. The placement of the cleaning implement 220 may be accomplished by positioning the apparatus 100 or the cleaning implement 220 as desired by the user. Next, the user grips the lever 114 by the gripping portion 212 and rotates the lever 114 from the pre-actuated position 190 to the actuated position 192. When the lever 114 is rotated the ratchet arm 160 will rotate also. The distal end 178 of the ratchet arm 160 will pass between the arm portions 172 of the lock 160 and engage at least one of the plurality of ratchet teeth 168 before the lever 114 reaches the actuated position 192. Continued movement of the lever 114 into the actuated position 192 will cause the first jaw 108 to pivot about a first jaw pivot 216 so that the opening 118 between the first jaw 108 and the second jaw 110 is reduced. The pivoting of the first jaw 108 will allow at least one of the plurality of ratchet teeth 168 to move past the arm portions 172 of the lock 162. Upon the lever 114 reaching the actuated position 192, the arm portions 172 of the lock 162 will engage at least one of the plurality of ratchet teeth 168 of the first jaw 108 locking the first jaw 108 into the position with the reduced opening 118. The user may then allow the ratchet spring 182 to rotate the lever 114 and ratchet arm 160 into the pre-actuated position 190. The user can repeat the action of moving the lever 114 from the pre-actuated position 190 to the actuated position 192 to reduce the opening between the first jaw 108 and the second jaw 110 until the teeth 120 securely engage the cleaning implement 220.

When the user wants to replace or remove the cleaning implement 220, the following process is followed. The user may position the cleaning implement 220 in a favorable location (e.g., over a trash can or a storage container). The user then presses the release button 116 of the apparatus 100. The release button 116 rotates about the release pivot 200 and the distal end 202 of the release button 116 engages the base portion 170 of the lock 162. The distal end 202 of the release button 116 pressing on the base portion 170 of the lock 162 causes the lock 162 to rotate about the lock pivot 176 and the arm portions 172 of the lock 162 rotate away from the plurality of ratchet teeth 168. The lock 162 releases the first jaw 108 and allows the first jaw spring 136 to decompress. The decompression of the first jaw spring 136 forces the first jaw 108 to pivot away from the second jaw 110 and releases the cleaning implement.

Figure 13:
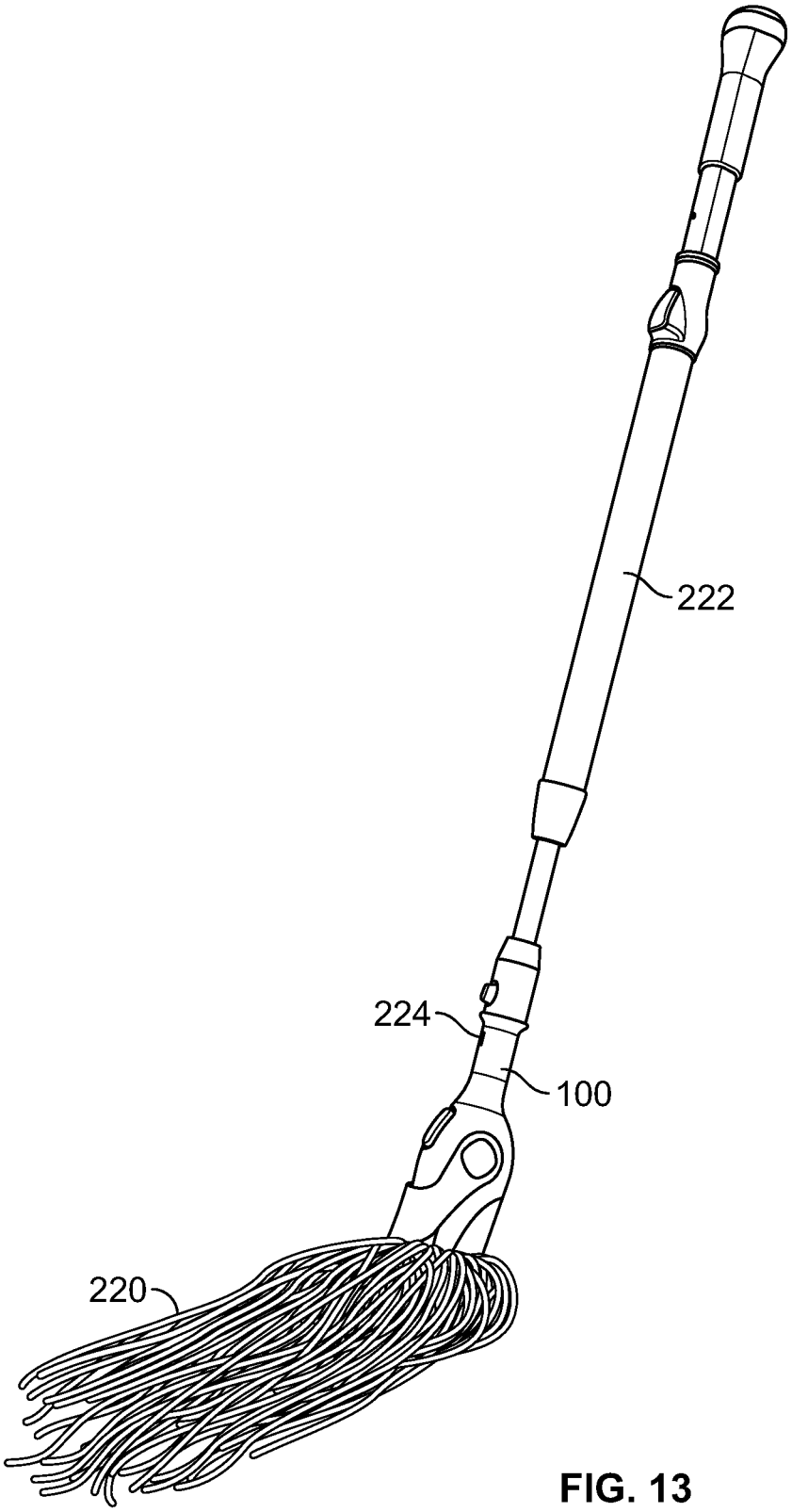
FIG. 13 is a perspective view of the apparatus of FIG. 1 depicting an attached handle and a retained cleaning implement.

FIG. 13 depicts an apparatus 100 retaining a cleaning implement 220 while attached to an extendable handle 222. This arrangement represents only one of the possible embodiments. There are many types of articles known to those with ordinary skill in the art that could be retained by the apparatus 100. Similarly, there are many different types of handles that could be connected to the apparatus 100.

The apparatus 100 provides a more efficient way of retaining a cleaning implement while allowing a user to not touch the cleaning implement when changing out a soiled cleaning implement. The adjustable nature of the jaws allows for different sized cleaning implements to be retained and thus adds flexibility to the user in the choice of cleaning implement used.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides an apparatus for retaining a cleaning implement wherein the apparatus is adapted to receive the cleaning implement between a pivoting jaw and a stationary jaw. The apparatus may be operated by a user without the user handling the cleaning implement.

The invention claimed is:

1. An apparatus to retain an article, the apparatus comprising:
   - a housing adapted to receive a handle;
   - a first jaw having opposing inner and outer ends, and being pivotably connected to the housing about an axis between the inner and outer ends, wherein the inner end comprises a plurality of ratchet teeth;
   - a second jaw opposite the first jaw;
   - a ratchet arm pivotably mounted in the housing and having a distal end dimensioned to engage the ratchet teeth of the first jaw when pivoted to an actuated position;
   - a lever connected to the ratchet arm, and wherein actuating the lever causes the distal end of the ratchet arm to move the ratchet teeth to incrementally pivot the outer end of the first jaw toward the second jaw; and
   - a lock, pivotably mounted in the housing adjacent the ratchet teeth, and movable between a locked position, wherein the lock engages the ratchet teeth to hold the first jaw in position, and an unlocked position, wherein the lock is pivoted away from the ratchet teeth to allow the first jaw to pivot freely.

2. The apparatus of claim 1 further including a release button, wherein the release button is dimensioned to engage the lock, and wherein actuating the release button pivots the lock away from the ratchet teeth of the first jaw and the first jaw is biased by a first jaw spring so as to pivot the outer end of the first jaw away from the second jaw.

3. The apparatus of claim 2, wherein the lock includes more than one flange and a distal end of each flange is configured to engage the ratchet teeth of the first jaw.

4. The apparatus of claim 3, wherein the distal end of the ratchet arm is configured to pass between the flanges of the lock when the lever is actuated between a pre-actuated position and the actuated position.

5. The apparatus of claim 4, wherein the ratchet arm is biased by a ratchet spring to pivot away from the ratchet teeth of the first jaw when the lever is moved from the actuated position to the pre-actuated position.

6. The apparatus of claim 5, wherein the lock is biased by a lock spring to pivot toward the ratchet teeth of the first jaw when the release button is released.

7. The apparatus of claim 6, wherein the housing includes at least one aperture adapted to receive a retaining feature of the handle.

8. The apparatus of claim 7, wherein the housing includes a gripping portion.

9. An apparatus to retain a cleaning implement, the apparatus comprising:

a housing adapted to receive a handle;

a first jaw having opposing inner and outer ends, and being pivotably connected to the housing about an axis between the inner and outer ends, wherein the inner end comprises a gear portion;

a second jaw opposite the first jaw;

a ratchet arm pivotably mounted in the housing and having a distal end dimensioned to engage the gear portion of the first jaw when pivoted to an actuated position;

a lever connected to the ratchet arm, and wherein actuating the lever from a first position to a second position causes the distal end of the ratchet arm to engage the gear portion in the actuated position to incrementally pivot the outer end of the first jaw toward the second jaw to reduce an opening therebetween; and a lock, pivotably mounted in the housing adjacent the gear portion, and movable between a locked position, wherein the lock engages the gear portion to hold the first jaw in position, and an unlocked position, wherein the lock is pivoted away from the gear portion to allow the first jaw to pivot freely.

10. The apparatus of claim 9 further including a release button, wherein the release button includes a distal end configured to engage a base portion of the lock, and wherein actuating the release button pivots the distal ends of the lock away from the gear portion of the first jaw and the first jaw is biased by a first jaw spring so as to pivot the outer end of the first jaw away from the second jaw.

11. The apparatus of claim 10, wherein the distal end on the ratchet arm is configured to pass through an open end of the lock when the lever is actuated between the first position and the second position to engage the gear portion of the first jaw.

12. The apparatus of claim 11, wherein the ratchet arm is biased by a ratchet spring to pivot away from the gear portion of the first jaw when the lever is moved from the second position to the first position.

13. The apparatus of claim 12, wherein the lock is biased by a lock spring to pivot toward the gear portion of the first jaw when the release button is released.

14. The apparatus of claim 13, wherein the housing includes at least one aperture adapted to receive a retaining feature of the handle.

15. The apparatus of claim 14, wherein the housing includes a gripping portion.

16. The apparatus of claim 15, wherein the distal end of the release button is biased by a release button spring away from the base portion of the lock.

17. The apparatus of claim 16, wherein the first jaw and the second jaw include a plurality of teeth configured to grip the cleaning implement.

* * * * *